United States Patent [19]

Luebke

[11] Patent Number: 4,538,954

[45] Date of Patent: Sep. 3, 1985

[54] STACKER CRANE HAVING NARROW MAST STRUCTURE

[75] Inventor: Roger D. Luebke, Brown Deer, Wis.

[73] Assignee: Harnischfeger Corporation, Brookfield, Wis.

[21] Appl. No.: 556,977

[22] Filed: Dec. 1, 1983

[51] Int. Cl.[3] ..... B66C 19/00

[52] U.S. Cl. ..... 414/633; 414/283; 414/629; 414/673; 212/213; 187/9 E

[58] Field of Search ..... 414/277, 281, 283, 628, 414/629, 630, 631, 632, 633, 637, 673; 212/128, 129, 213; 187/9 E, 9 R, 94

[56] References Cited

U.S. PATENT DOCUMENTS

| | | | |
|---|---|---|---|
| 3,033,392 | 5/1962 | Baumann et al. | 414/281 |
| 3,269,561 | 8/1966 | Ligt | 212/128 |
| 3,270,893 | 9/1966 | Dechantsreiter | 212/128 X |
| 3,348,635 | 10/1967 | Nieminski | 212/128 |
| 3,848,703 | 11/1974 | Rundle | 212/128 X |
| 4,316,528 | 2/1982 | Dechantstreiter | 414/281 X |
| 4,331,418 | 5/1982 | Klebe | 414/277 |
| 4,417,838 | 11/1983 | Schultz et al. | 414/277 |

*Primary Examiner*—Joseph E. Valenza

*Assistant Examiner*—Ken Muncy

*Attorney, Agent, or Firm*—James E. Nilles

[57] ABSTRACT

The invention relates to a stacker crane comprising an upright rigid mast rotatably connected at its upper end to a horizontally movable trolley, an intermediate mast that is vertically movable relative to the rigid mast, and a load supporting carriage guided for vertical motion by both masts and raised and lowered by a winch on the trolley. The intermediate mast has an upwardly projecting pilot portion that is telescopingly received within the rigid mast to guide the intermediate mast for motion between a lowered position near floor level and a raised position wherein the top of the intermediate mast is contiguous to the bottom of the rigid mast. The carriage is guided by a pair of vertical rails on each mast, at its opposite sides, the rails on the intermediate mast being aligned with respective rails on the rigid mast. The intermediate mast is biased upward by a force that can be overcome by the weight of the carriage. Cooperating abutments on the carriage and the intermediate mast, engaged when the carriage is near the bottom of the intermediate mast, constrain the latter to move between its raised and lowered positions in unison with the carriage.

6 Claims, 5 Drawing Figures

STACKER CRANE HAVING NARROW MAST STRUCTURE

FIELD OF THE INVENTION

This invention relates to stacker cranes that are used for placing articles into and removing them from vertically spaced storage shelves or the like; and the invention is more particularly concerned with a stacker crane comprising an overhead trolley that carries a downwardly projecting mast structure upon which a load supporting carriage is guided for up and down motion, wherein the mast structure is vertically extensible and retractable so that it can clear articles on a floor across which it moves but is nevertheless unusually narrow so as to be operable in relatively narrow aisles between storage shelves.

BACKGROUND OF THE PRIOR ART

A stacker crane comprises a bridge-like overhead trolley which runs along laterally spaced overhead tracks and from which a mast structure projects downward that guides a load supporting carriage in up and down motion. The carriage can be brought to any desired position in the working space by a combination of its own up and down motion along the mast structure, rotation of the mast structure relative to the trolley, and horizontal movement of the trolley along the rails.

In a typical installation, a stacker crane is used with racks that provide storage stations arranged in horizontal rows and vertical columns. Usually such racks are located on opposite sides of an aisle along which the mast structure moves as it carries the carriage to a selected column of storage stations.

Because the load supporting carriage comprises a fork that projects from one side of the mast structure, the width of any aisle in which the crane has to perform loading and unloading operations has to be equal to the distance by which the carriage projects horizontally from the mast structure, plus the width of the mast structure, plus reasonable clearance. Ordinarily the width of a stacker crane mast structure is on the order of three feet, so that the mast structure accounts for a significant part of the needed aisle width. In turn, aisle width multiplied by the length of the aisle or aisles along which the stacker crane operates determines the number of square feet of floor space that must be dedicated to the operation of the crane. In general, the cost of a warehouse building is proportional to its floor area, regardless of whether floor area is utilized for storage or for access to stored materials, and this cost-floor area relationship applies not only to initial construction cost but also to such continuing costs as maintenance, taxes and insurance. Ultimately, therefore, a few inches more or less in the width of a stacker crane mast structure can have far reaching economic consequences.

In a stacker crane of the type here under consideration, the mast structure conventionally comprises a rigid mast and an intermediate mast. The rigid mast has its upper end connected to the overhead trolley and its lower end spaced a substantial distance above floor level. The intermediate mast moves up and down relative to the rigid mast. In a lowered position the intermediate mast provides a downward extension of the rigid mast that enables the carriage to be brought all the way down to floor level for loading and unloading. In a raised position of the intermediate mast the mast structure is clear of any persons and articles on the floor over which it travels.

Typical prior stacker crane mast structures are disclosed in U.S. Pat. No. 3,144,137 to Vallierre et al, U.S. Pat. No. 3,269,561 to DeLigt, U.S. Pat. No. 3,270,893 to Dechantsreiter, and U.S. Pat. No. 4,316,528 to Dechantsreiter.

In each of these, the intermediate mast surrounded the rigid mast and moved up and down along it. The carriage was in turn guided on the intermediate mast. In a lower range of carriage motion the intermediate mast projected below the rigid mast, nearly to floor level, while the carriage moved up and down relative to the intermediate mast; whereas in an upper range of carriage motion the carriage remained stationary relative to the intermediate mast, near the upper end of it, while the intermediate mast moved up and down along the rigid mast.

With the arrangement just described, the intermediate mast was necessarily wider than the rigid mast, in order to surround it for guidance up and down along it. However, the minimum width that the rigid mast could have was controlled by the requirement that it be stiff enough to resist excessive bowing along its length under the deflecting forces imposed upon it by load moments exerted through the fork of the carriage.

In the light of the present invention, it can be seen that the additional width contributed to the mast structure by the intermediate mast was required solely for guidance of the intermediate mast and offered no benefit with respect to strength or rigidity of the mast structure.

In some cases the effective width of the mast structure was further increased by the carriage, which was arranged in surrounding relation to the intermediate mast.

SUMMARY OF THE INVENTION

The general object of the present invention is to provide a stacker crane of the character described wherein the effective width of the mast structure is no greater than the width of the rigid mast, to thus achieve minimal aisle width between tiers of shelves or the like that are serviced by the crane, with corresponding economy in floor area of the building in which the crane operates.

In the attainment of this object it is a further object of the invention to provide a mast structure that comprises a rigid mast which projects downwardly from an overhead trolley and an intermediate mast which is movable up and down relative to the rigid mast but is no wider than the rigid mast, the intermediate mast being movable between a raised position in which it is spaced a substantial distance above the level of a floor, for clearing articles on the floor, and a lowered position in which it allows a load supporting carriage that moves up and down along the mast structure to be brought all the way down to the floor.

It is also an object of this invention to provide a stacker crane mast structure of the character described that is of minimal width to conserve aisle space but is nonetheless sturdy and mechanically simple so as to be low in first cost and reliable in operation.

Another and more specific object of the invention is to provide a stacker crane mast structure which is so arranged that the operator of the crane has a minimum of obstruction of his view of the load supporting fork of the carriage.

In general, these and other objects of the invention that will appear as the description proceeds are attained in a crane comprising a horizontally movable overhead trolley, an upright rigid mast having at an upper end thereof a connection with the trolley that confines the rigid mast to rotation about its own axis relative to the trolley and having its lower end spaced a substantial distance above a floor, an intermediate mast movable relative to said rigid mast down to and up from a lowered position in which a bottom end of the intermediate mast is at a substantially smaller distance above the floor, a carriage movable up and down relative to both of said masts and having means thereon for supporting a load, and a winch carried by the trolley and connected with the carriage for raising and lowering it. The crane of this invention is characterized by said masts having substantially like external dimensions in cross-section, and one of said masts having a lengthwise projecting pilot element fixed thereon which is of smaller external dimensions in cross-section than said masts and is telescopingly received in the other of said masts to guide the intermediate mast for vertical motion between its said lowered position and a raised position in which the top end of the intermediate mast is contiguous to the lower end of the rigid mast. Biasing means reacting between the rigid mast and the intermediate mast urge the latter towards its raised position. Each of said masts has a pair of guide rails extending vertically therealong, one at each of a pair of opposite sides thereof, the guide rails on the intermediate mast being vertically aligned with respective guide rails on the rigid mast. Guide means on the carriage cooperate with the guide rails on the masts to confine the carriage to vertical motion relative to the masts. Cooperating abutment means on the carriage and on the intermediate mast, engaged when the carriage is near the bottom of the intermediate mast, constrain the intermediate mast to move up and down with the carriage between its raised and its lowered positions.

Preferably the rigid mast is hollow and of substantially rectangular cross-section, and said pilot element is fixed to the intermediate mast, projects upwardly therefrom, and is telescopingly received within the rigid mast.

It is also preferred that the biasing means comprise a counterweight movable up and down inside the rigid mast and having a mass substantially equal to that of the intermediate mast with the guide element fixed thereto, a freely rotatable sheave carried by the rigid mast near the upper end thereof, and a rope trained over said sheave and connected between the counterweight and the intermediate mast.

BRIEF DESCRIPTION OF THE DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
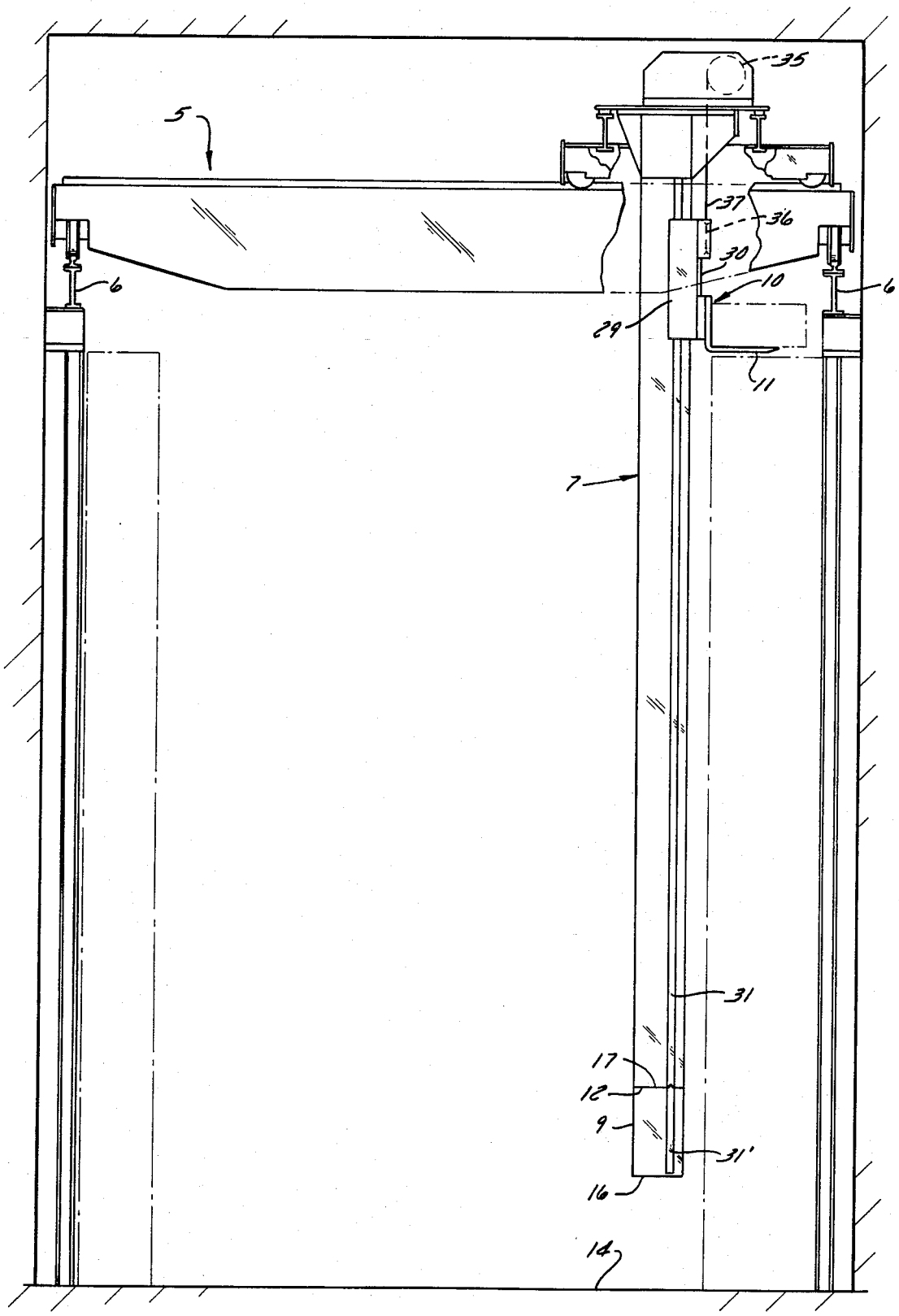
FIG. 1 is a view in elevation of a stacker crane of this invention with its load supporting carriage in a substantially fully raised position.
Figure 2:
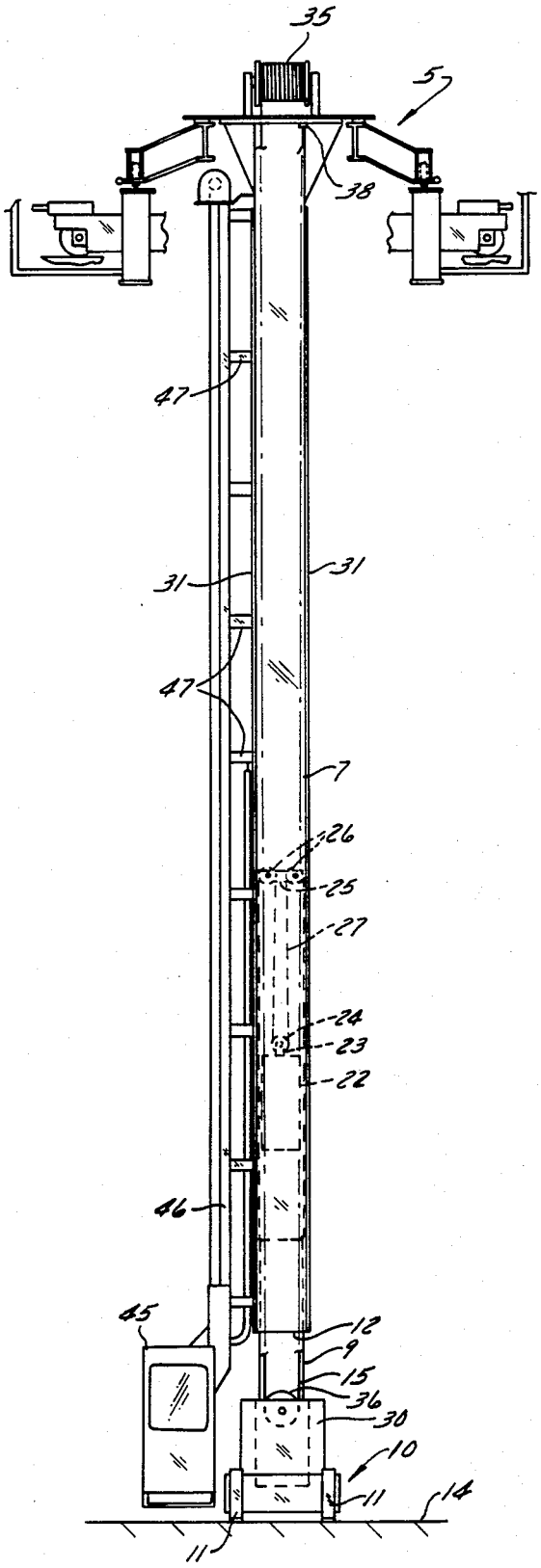
FIG. 2 is a view in elevation taken at right angles to the plane of FIG. 1 and showing the carriage in its fully lowered position.
Figure 3:
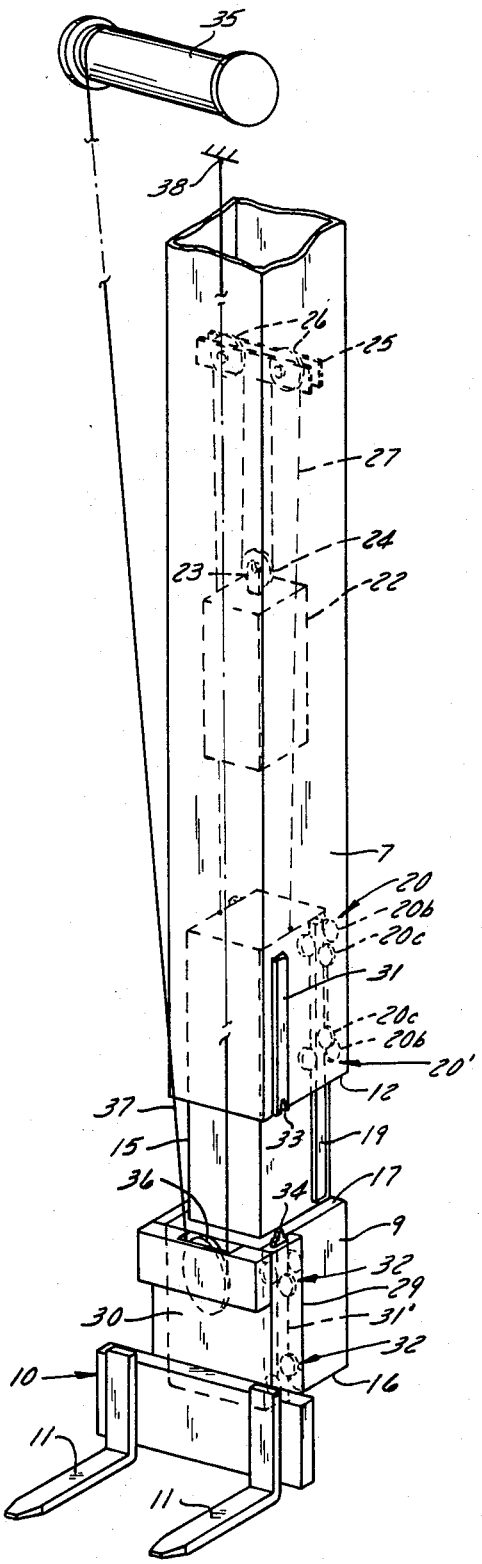
FIG. 3 is a fragmentary and somewhat diagrammatic perspective view of the mast structure and load supporting carriage.

The stacker crane of this invention is conventional in that it comprises an overhead trolley 5 which rides on spaced, parallel overhead rails 6 and from which a rigid mast 7 projects downwardly. The trolley 5 is arranged in a known manner to provide for horizontal translatory movement of the rigid mast 7 in all directions. As is also conventional, the rigid mast 7 is so connected with the trolley 5 as to be confined to rotation about its own axis relative to the trolley. An intermediate mast 9 that is movable up and down relative to the rigid mast cooperates with it in guiding a vertically movable load supporting carriage 10 that is here illustrated as comprising a horizontally projecting load engaging fork 11.

The lower end 12 of the rigid mast 7 is spaced at a substantial distance above the level of a floor 14 across which the crane travels, and the intermediate mast 9 provides in effect a downward extension of the rigid mast that enables the carriage 10 to be lowered all the way to floor level. A distinctive feature of the stacker crane of this invention is that the intermediate mast 9 is always below the rigid mast 7.

The rigid mast 7 is preferably square or rectangular in cross-section and of hollow, box-like construction. The intermediate mast 9 not only has the same configuration in cross-section as the rigid mast (i.e., square or rectangular, as the case may be) but also has the same external cross-section dimensions as the rigid mast. Further, the intermediate mast 9 has fixed thereto an upwardly projecting pilot element 15 that is telescopingly received in the hollow interior of the rigid mast and cooperates therewith in guiding the intermediate mast 9 for vertical motion between a lowered position in which the bottom end 16 of the intermediate mast is near the floor 14 and a raised position in which the intermediate mast has its bottom end spaced well above the floor and its top end 17 directly contiguous to the lower end 12 of the rigid mast.

It will be apparent that the range of vertical travel of the intermediate mast 9 depends upon the length of the pilot element 15, which must of course maintain guiding engagement with the rigid mast 7 in all positions of the intermediate mast.

As here shown, the guiding connection between the pilot element 15 and the rigid mast 7 comprises a pair of vertically extending rails 19 on the pilot element, one along each of its opposite sides, and sets of freely rotatable rollers at fixed locations on the rigid mast 7 that engage the rails 19. Each set of rollers comprises front and rear rollers **20*a* and 20*b*, respectively, that engage the front and rear surfaces of a rail 19, and a third roller 20*c* that engages the side surfaces of the rail; and each rail 19 is engaged by two vertically spaced apart sets 20, 20' of such rollers, so that the several rollers cooperate with the rails to confine the intermediate mast 9** to vertical motion relative to the rigid mast.

The intermediate mast 9 is urged upwardly towards its raised position with a biasing force that can be overcome by imposing the weight of the unloaded carriage 10 upon it. Any suitable biasing means that reacts between the rigid mast and the intermediate mast can be employed for this purpose, as for example springs connected between the rigid mast 7 and the pilot element 15, or a torque motor mounted on the rigid mast and connected with the pilot element in a manner that will be obvious to those familiar with such devices. The biasing means here shown, which is preferred for economy, simplicity and reliability, comprises a counterweight 22 that is movable up and down in the hollow interior of the rigid mast and has a mass slightly greater than the combined mass of the intermediate mast 9 and the pilot element 15. A bracket 23 fixed on the top of the counterweight 22 supports a freely rotatable sheave 24 that has its axis vertically aligned with the center of gravity of the counterweight. In the interior of the rigid mast 7, near its upper end, are a pair of fixed sheave brackets 25 which project inwardly from opposite sides of the rigid mast and each of which supports a freely rotatable sheave 26. To connect the counterweight for reaction between the rigid mast and the intermediate mast, a wire rope 27 has its opposite ends anchored to the top of the pilot element 15 and is trained over each of the mast sheaves 26 and under the counterweight sheave 24. The counterweight thus constantly urges the intermediate mast 9 towards its raised position.

Figure 5:
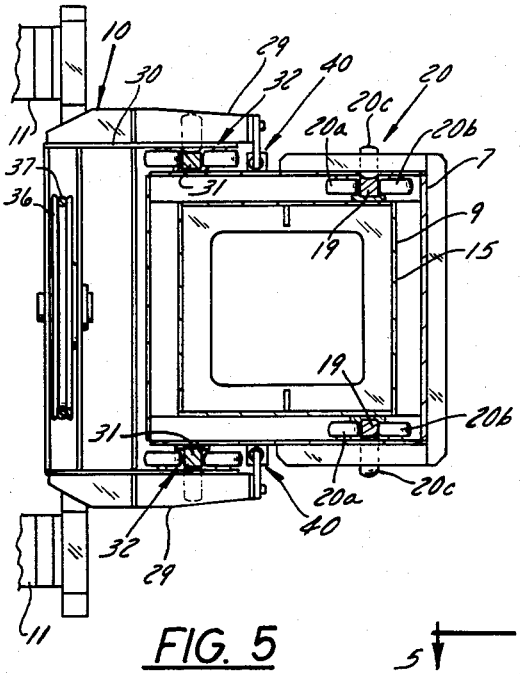
FIG. 5 is a view in section taken on the plane of the line 5—5 in FIG. 4.
Figure 4:
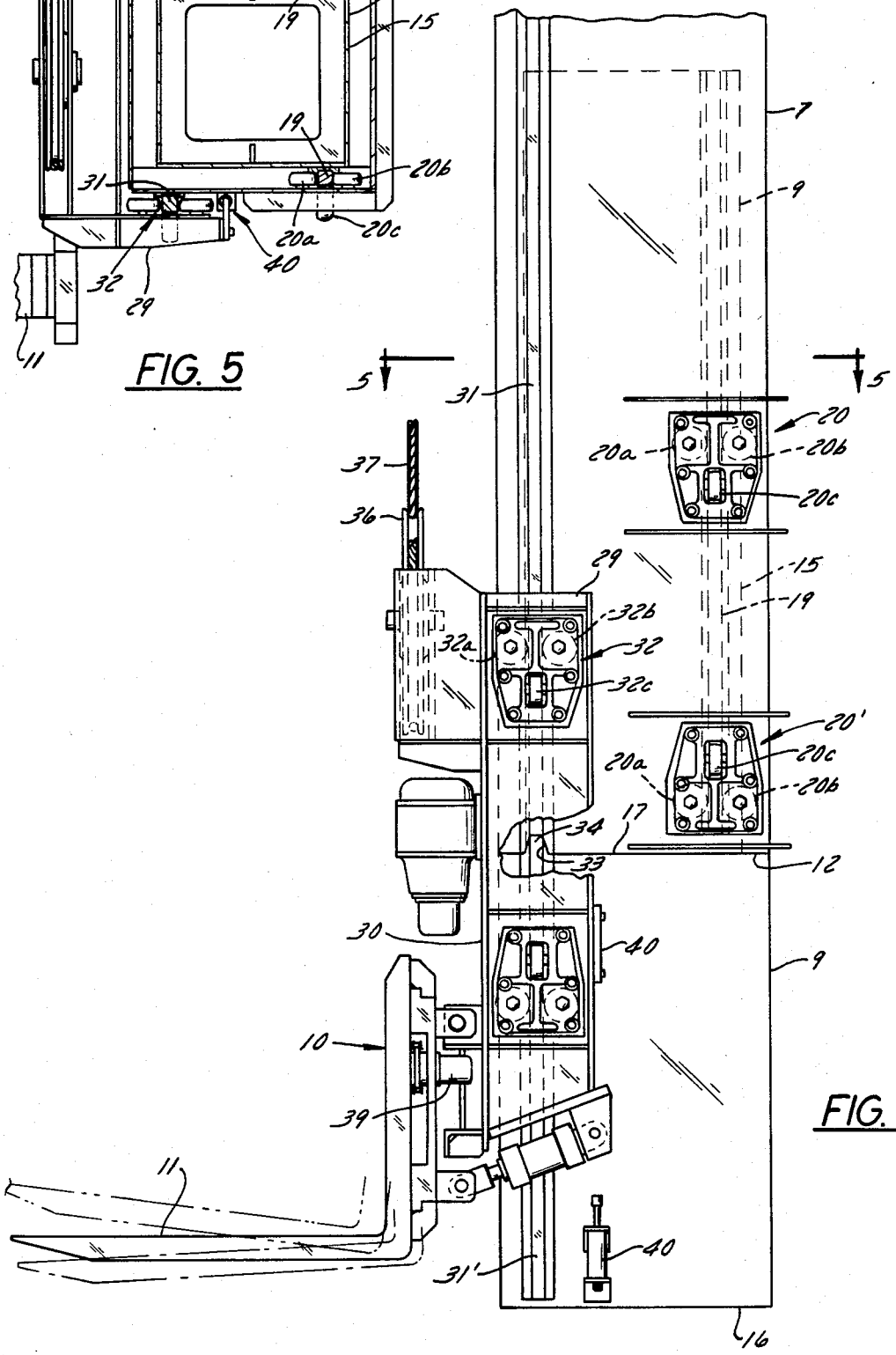
FIG. 4 is a view in elevation on an enlarged scale showing the carriage and the lower portion of the mast structure with the intermediate mast in its raised position and the carriage in an intermediate or transition position wherein it engages both the rigid mast and the intermediate mast.

The carriage 10 has a frame that is essentially C-shaped in plan view (FIG. 5), with a pair of arms 29 that project rearwardly from a transverse front member 30 to overlie opposite sides of the masts 7 and 9. It will be observed that the carriage frame embraces the front portions of the masts 7 and 9 rather than surrounding the masts, and insofar as no portion of the carriage lies behind the rear surface of the masts, this carriage frame configuration helps to keep aisle width requirements to a minimum.

For guiding the carriage 10 in its up and down movement, each of the masts 7 and 9 has a pair of vertical rails 31, 31', respectively, one at each side of it, each extending along the full length of the mast. Each rail 31' on the intermediate mast 9 is vertically aligned with a rail 31 on the rigid mast 7. On the rearwardly projecting arms 29 of the carriage frame there are roller sets 32 that cooperate with the rails 31, 31' in confining the carriage 10 to up and down motion along the masts 7, 9.

As with the rollers on the rigid mast that guide the pilot element 15, the rollers 32 at each side of the carriage 10 are arranged in an upper set and a lower set, each set comprising a front roller **32*a* and a rear roller 32*b* that respectively engage the front and rear surfaces of a rail 31, 31' , together with a side roller 32*c*** that engages the side surface of the rail.

It will be observed that when the intermediate mast 9 is in its raised position, its carriage guiding rails 31' are, in practical effect, downward continuations of the rails 31 on the rigid mast 7, so that the carriage 10 can then move smoothly from one to the other of the masts 7 and 9. To further ensure smooth movement of the carriage from one mast to the other, the lower end of each rail 31 on the rigid mast 7 is formed with a downwardly opening notch 33, and the upper end of each rail 31' on the intermediate mast 9 is formed with a mating upwardly projecting cusp 34, so that the aligned rails are connected by a dovetail joint as the intermediate mast is brought up to its raised position.

As is generally conventional in stacker cranes of the type to which this invention relates, the carriage 10 is moved up and down by means of a winch 35 that is mounted on the overhead trolley 5. On the transverse front member 30 of the carriage frame is mounted a freely rotatable sheave 36 that has its fore-and-aft extending axis centered between the side arms 29 of the carriage frame. A wire rope 37 that has one end anchored to the winch drum is looped under that sheave 35 and has its other end anchored to the trolley as at 38.

It will be understood that the fork 11 on the carriage can have its forwardly projecting prongs so mounted on the transverse member 30 of the carriage frame as to be adjustable toward and from one another, and that the carriage frame also carries generally conventional mechanism, comprising a motor 39, for effecting such adjustment of the fork prongs.

Whenever the carriage 10 is in an upper range of its vertical motion, in which it is engaged with the rails 30 on the rigid mast 7, the intermediate mast 9 is in its raised position; and the intermediate mast remains in that position as the carriage moves down off of the rigid mast and along the intermediate mast, until the carriage frame engages a pair of bumpers 40 on the intermediate mast, one at each side of it, located near its bottom end. Thereafter, as the carriage is further lowered, its weight is imposed upon the intermediate mast to overcome the biasing force of the counterweight. Thus, in a lower range of carriage motion the carriage remains engaged with the bumpers 40 and does not move relative to the intermediate mast, but the intermediate mast and the carriage, together, move up and down relative to the rigid mast.

The stacker crane of this invention is well suited for being controlled from an operator's cab 45 which is movable up and down along a cab mast 46 that is carried by the trolley 5 at one side of the mast structure 7, 9. Because the frame of the carriage 10 embraces only the front portion of the rigid mast 7 when the carriage is in its upper range of vertical motion, laterally extending struts 47 can be connected between the cab mast 46 and one side of the rigid mast 7, near the rear of the latter, for mutual bracing of those masts 46 and 7. The cab 45 and its mast 46, being sidewardly in line with the mast structure 7, 9 and the carriage 10, impose no requirement for aisle width beyond that needed for accommodating the mast structure and the carriage. Furthermore, because the mast structure 7, 9 of this invention is relatively narrow, it presents minimal obstruction to visibility for the crane operator in the cab, allowing a good view of the carriage fork 11 and along any aisle in which the crane is moving.

From the foregoing description taken with the accompanying drawings it will be apparent that this invention provides a stacker crane which has a substantially narrower mast structure than prior stacker cranes of equivalent capacity, and which can therefore operate in a narrower aisle, to correspondingly increase the proportion of floor space in a warehouse or the like that can be devoted to storage; and it will be further apparent that the stacker crane of this invention, notwithstanding its compactness, is sturdy, simple, reliable and low in cost.

What is claimed as the invention is:

1. A crane comprising a horizontally movable overhead trolley, an upright rigid mast having at an upper end thereof a connection with the trolley that confines it to rotation about its own axis relative to the trolley, the lower end of said rigid mast being spaced a substantial distance above a floor, an intermediate mast movable relative to said rigid mast down to and up from a lowered position in which a bottom end of the intermediate mast is at a substantially smaller distance above the floor, a carriage movable up and down relative to both of said masts and having means thereon for supporting a load, and a winch carried by the trolley and connected with the carriage for raising and lowering it, said crane being characterized by:

A. one of said masts having a lengthwise projecting pilot element fixed thereon
   (1) which is of smaller cross-section than the other of said masts and
   (2) which is telescopingly received in said other of the masts to guide the intermediate mast for motion between its said lowered position and a raised position in which the top end of the intermediate mast is contiguous to the lower end of the rigid mast;

B. each of said masts having a pair of guide rails extending vertically therealong, one at each of a pair of opposite sides thereof, the guide rails on the intermediate mast being vertically aligned with respective guide rails on the rigid mast;

C. biasing means reacting between the rigid mast and the intermediate mast to urge the latter toward its raised position;

D. guide means on said carriage cooperating with said guide rails on the masts to confine the carriage to vertical motion relative to the masts; and E. cooperating abutment means on the carriage and on the intermediate mast, engaged when the carriage is near the bottom of the intermediate mast, to constrain the intermediate mast to move up and down with the carriage between its raised and its lowered positions.

2. The crane of claim 1 wherein said rigid mast is hollow and of substantially rectangular cross-section and wherein said pilot element is fixed to the intermediate mast, projects upwardly therefrom and is telescopingly received within the rigid mast.

3. The crane of claim 2 wherein said biasing means comprises:

(1) a freely rotatable sheave carried by said rigid mast at a location near the upper end thereof;

(2) a counterweight movable up and down inside the rigid mast and having a mass substantially equal to that of the intermediate mast with said pilot element; and (3) a rope trained over said sheave and connected between said counterweight and the intermediate mast.

4. A crane comprising a horizontally movable overhead trolley, an upright rigid mast having at an upper end thereof a connection with the trolley that confines it to rotation about its own axis relative to the trolley, the lower end of said rigid mast being spaced a substantial distance above a floor, an intermediate mast movable relative to said rigid mast down to and up from a lowered position in which a bottom end of the intermediate mast is at a substantially smaller distance above the floor, a load supporting carriage movable up and down relative to both of said masts, and a winch carried by the trolley and connected with the carriage for raising and lowering it, said crane being characterized by:

A. an upwardly projecting pilot portion on the intermediate mast telescopingly received within the rigid mast and cooperating with the latter to guide the intermediate mast for vertical motion between its said lowered position and a raised position in which the top end of the intermediate mast is contiguous to the lower end of the rigid mast;

B. a pair of vertical guide rails on each of said masts, one at each of a pair of opposite sides of the mast, each guide rail on the intermediate mast being vertically aligned with a guide rail on the rigid mast;

C. guide means on the carriage cooperating with said guide rails to confine the carriage to vertical motion relative to the masts;

D. biasing means reacting between the rigid mast and the intermediate mast to urge the latter towards its raised position with an upward force that can be overcome by the weight of the carriage; and E. cooperating abutment means on the carriage and on the intermediate mast, engaged when the carriage is near the bottom of the intermediate mast and whereby the intermediate mast is constrained to move between its raised and its lowered positions in unison with the carriage.

5. The crane of claim 4, further characterized by:

F. the carriage having a frame comprising
   (1) a transverse member which overlies a front surface of the mast with which the carriage is engaged and
   (2) a pair of arms which project rearwardly from opposite ends of said transverse member, towards the respective guide rails, and which carry said guide means.

6. The crane of claim 5 wherein each of said rails is substantially nearer to the front surface of its mast than to an opposite rear surface thereof.

* * * * *